United States Patent [19]

Waite

[11] 4,251,598

[45] Feb. 17, 1981

[54] REFLECTIVE INSULATIVE PANEL

[75] Inventor: William Waite, Chicago, Ill.

[73] Assignee: Transco, Inc., Chicago, Ill.

[21] Appl. No.: 941,022

[22] Filed: Sep. 11, 1978

[51] Int. Cl.³ ..... B21D 13/00; E04C 2/04; B32B 3/28

[52] U.S. Cl. ..... 428/603; 428/604

[58] Field of Search ..... 52/615; 428/603, 604

[56] References Cited

U.S. PATENT DOCUMENTS

| | | | |
|---|---|---|---|
| 2,481,046 | 9/1949 | Shurlock | 428/604 |
| 3,151,712 | 10/1964 | Jackson | 52/615 |
| 3,299,598 | 1/1967 | Alleaume | 428/604 |
| 3,302,359 | 2/1967 | Alleaume | 428/604 |
| 3,506,412 | 4/1970 | Saldern | 428/604 |
| 3,510,278 | 5/1970 | Alleaume | 428/604 |

*Primary Examiner*—Brooks H. Hunt

*Attorney, Agent, or Firm*—Edward C. Threedy

[57] ABSTRACT

A heat reflective and insulative prefabricated panel consisting of a metallic outer facing sheet and a metallic backing sheet encapsulating a plurality of cellular foil sheets. The foil sheets are preformed to present raised ribs which are adapted to cooperate with like ribs of juxtaposed sheets to define enclosed cells that prevent heat transfer by convection.

1 Claim, 3 Drawing Figures

REFLECTIVE INSULATIVE PANEL

SUMMARY OF THE INVENTION

The object of this invention is to provide a prefabricated insulative panel for the purpose of inhibiting convention therethrough.

In the past prefabricated heat reflective insulative panels consisted of porous batts of insulating material, such as fiberglass or randomly crumpled sheets of aluminum or stainless steel foil. However, these materials did not prevent the loss of heat through transfer of air movement between the materials making up the interior of the prefabricated panels.

The panel of this invention comprises a plurality of layers of foil, preferably made from aluminum or stainless steel, which are preformed into identical patterns such that when they are nested with a succeeding layer or sheet, there will be provided a series of closed cells that inhibit air movement therebetween, thus preventing heat loss due to convection. The cellular layers of foil are of a thickness which possesses form-retaining rigidity while being lightweight and easily adaptable to being constructed into a prefabricated panel. The superimposed or nested sheets of foil will be encapsulated between a metallic facing sheet and a metallic backing sheet, both of which possess heat reflective qualities and which may be corrugated throughout their length if desired.

GENERAL DESCRIPTION

Figure 1:
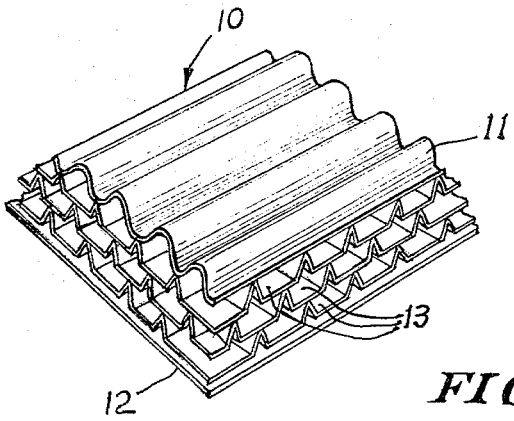
Figure 2:
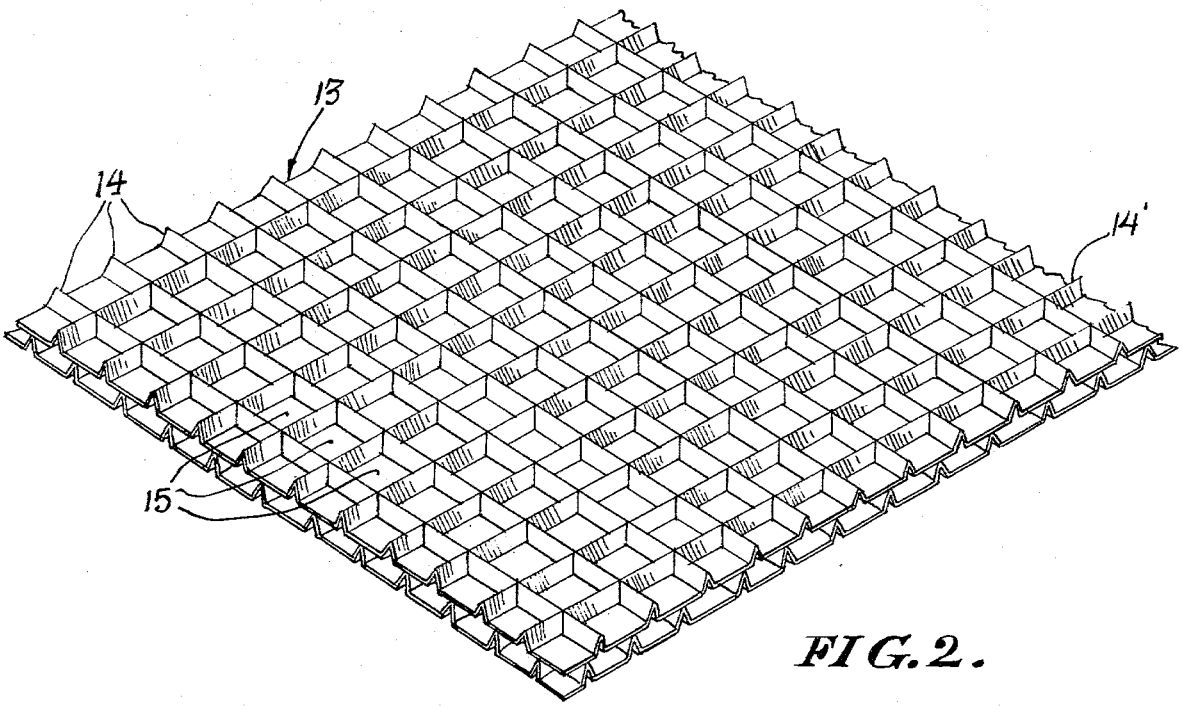
Figure 3:
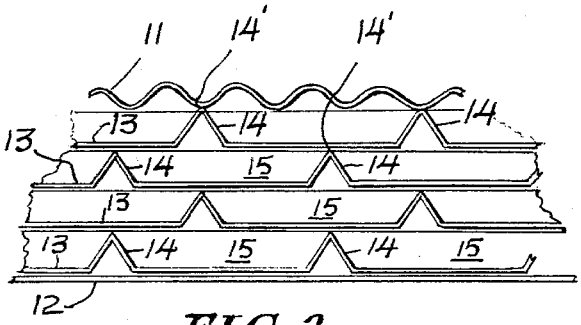

The invention will be best understood by reference to the accompanying drawings, in which:

FIG. 1 discloses a fragmentary perspective view of a prefabricated heat reflective insulative panel;

FIG. 2 is a fragmentary perspective view of a layer of foil being preformed so as to provide a plurality of cells; and FIG. 3 is a fragmentary side elevational view of a prefabricated panel embodying a plurality of the sheets shown in FIG. 2.

As shown in FIG. 1, a prefabricated heat reflective insulative panel 10 includes a metallic facing sheet 11 which, as shown, may be corrugated throughout its length, as well as a metallic backing sheet 12. Interposed between the metallic facing sheet 11 and the metallic backing sheet 12 are a series of sheets or layers of foil 13. These elements may be assembled together into a prefabricated panel by any well-known fastening means, such as connector pins and fastener plates, prongs, or the like.

The internal layers of foil 13 of the panel 10 may, as shown in FIG. 2, be preformed so as to provide raised triangularly-shaped ribs 14, with the ribs extending at right angles to each other throughout the length of the sheet or layer 13 as well as transversely thereof. As such, the ribs provide a cellular sheet made up of a plurality of individual cells 15.

Referring to FIG. 3, which is a cross section of the prefabricated panel shown in FIG. 1, it is readily seen that the foil layers or sheets 13 are nested between the facing sheet 11 and the metallic backing sheet 12. In order to form a cellular internal construction for the panel 10, the sheets or layers 13 are arranged to that the raised triangularly-shaped ribs 14 of each are alternately offset with respect to each other so as to provide enclosed cells 15 throughout the interior of the panel 10. These cells entrap and prevent motion of air between the facing sheet 11 and backing sheet 12 so as to prevent heat loss through convection.

It should be noted that the layer or sheet 13 is preferably formed from aluminum or stainless steel foil and, as such, has a thickness which possesses form-retaining rigidity without embodying weight characteristics. The ribs 14 are generally triangular in cross section, which form adds to their form-retaining rigidity and permits the apex 14' of such ribs to support the juxtapositioned layer or sheet 13. This function is important in an insulating panel, in that by such arrangement there is provided minimum contact between layers or sheets 13 with a resulting minimum heat transfer therebetween. Thus, when the panel 10 is assembled, as heretobefore described, it will be lightweight yet have sufficient structural rigidity so as to be readily applied to any form requiring heat reflective insulation.

Regardless of the form of the cells which are employed to make up the cellular layer of sheets or foil comprising the internal elements of the prefabricated panel, there will result the establishment of closed cell units which cooperate to prevent movement of air therebetween, thus inhibiting heat loss through convection. The desired form of the cellular panel may be dictated by the required thickness of the prefabricated panel 10.

While I have illustrated and described the preferred form of construction for carrying my invention into effect, this is capable of variation and modification without departing from the spirit of the invention. I, therefore, do not wish to be limited to the precise details of construction set forth, but desire to avail myself of such variations and modifications as come within the scope of the appended claims.

I claim:

1. A heat insulative and reflective prefabricated panel comprising:

(a) a metallic facing sheet and a metallic backing sheet extending substantially in spaced parallel relation, (b) layers of foil encapsulated between said facing and said backing sheets, (c) each layer of foil being preformed to provide rectangularly spaced cells, (d) each of said cells defined by a rib substantially triangular in close section and extending at right angles to each other so as to provide a raised apex defining each of said rectangular cells, and (e) with said layers of foil being superimposed upon one another with said ribs of each cell in each layer disposed offset vertically and horizontally to form a pattern of cellular units with the cellular units of one layer closed from the cellular units of the superimposed layer, with only said apex of said one layer in contact with the juxtaposed other layer so as to restrict heat transfer between.

* * * * *